US006463407B2

(12) United States Patent
Das et al.

(10) Patent No.: US 6,463,407 B2
(45) **Date of Patent: *Oct. 8, 2002**

(54) LOW BIT-RATE CODING OF UNVOICED SEGMENTS OF SPEECH

(75) Inventors: Amitava Das; Sharath Manjunath, both of San Diego, CA (US)

(73) Assignee: Qualcomm Inc., San Diego, CA (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/191,633

(22) Filed: Nov. 13, 1998

(65) Prior Publication Data

US 2001/0049598 A1 Dec. 6, 2001

(51) Int. Cl.[7] ..... G10L 11/06; G10L 11/04
(52) U.S. Cl. ..... 704/208; 704/206
(58) Field of Search ..... 704/201, 205–208, 704/230, 200.1

(56) References Cited

U.S. PATENT DOCUMENTS 5,327,521 A * 7/1994 Savic et al. ..... 704/200
5,381,512 A * 1/1995 Holton et al. ..... 704/202
5,414,796 A 5/1995 Jacobs et al. ..... 395/2.3
5,490,230 A * 2/1996 Gerson et al. ..... 704/225
5,517,595 A * 5/1996 Kleijn ..... 704/205
5,839,102 A * 11/1998 Haagen et al. ..... 704/212

FOREIGN PATENT DOCUMENTS

WO 9528824 11/1995

OTHER PUBLICATIONS

Morris ("A PC–Based Digital Speech Spectrograph", IEEE Micro pp. 68–85, Dec. 1988).*

(List continued on next page.)

*Primary Examiner*—Richemond Dorvil
*Assistant Examiner*—Daniel A. Nolan
(74) *Attorney, Agent, or Firm*—Philip R. Wadsworth; Kent D. Baker; Thomas R. Rouse

(57) ABSTRACT

A low-bit-rate coding technique for unvoiced segments of speech includes the steps of extracting high-time-resolution energy coefficients from a frame of speech, quantizing the energy coefficients, generating a high-time-resolution energy envelope from the quantized energy coefficients, and reconstituting a residue signal by shaping a randomly generated noise vector with quantized values of the energy envelope. The energy envelope may be generated with linear interpolation technique. A post-processing measure may be obtained and compared with a predefined threshold to determine whether the coding algorithm is performing adequately.

21 Claims, 7 Drawing Sheets

OTHER PUBLICATIONS

Fischer et al (T. Fischer & K.Malone, "Transform Coding of Speech with Pyramid Vector Quantization," Proceedings of the Military Communications Conference, 1985).*

Q. Qureshi, T. Fisher, "A Hardware Processor for Implementing the Pyramid Vector Quantizer," IEEE Transactions on Acoustics, Speech and Signal Processing, Jul. 1989.*

H. Yasukawa, "Restoration of Wide Band Signal from Telephone Speech using Linear Prediction Error Processing," International Conference on Spoken Language, Oct. 1996.*

1978 Digital Processing of Speech Signals, "Linear Predictive Coding of Speech", Rabiner et al., pp. 396–453.

1993 IEEE Speech Coding Workshop, "Performance of Noise Excitation for Unvoiced Speech", Kubin et al., pp. 35–36.

1995 Speech Coding and Synthesis, "Linear–Prediction based Analysis–by–Synthesis Coding", Kroon et al., pp. 79–119; "Sinusoidal Coding", McAulay et al., pp. 121–173; "Multimode and Variable–Rate Coding of Speech", Das et al., pp. 257–288.

Chung, et al. "Design of a Variable Rate Algorithm for the 8 KB/S CS–ACELP Coder" 48$^{th}$ IEEE Vehicular Technology Conference 3: 2378–2382 (1998).

Das, et al. "Multimode Variable Bit Rate Speech Coding: An Efficient Paradigm for High–Quality Low–Rate Representation of Speech Signal" IEEE Int'l Conf. On Acoustics, Speech, and Signal Processing 4: 2307–2310 (1999).

Fischer, et al. "Transform Coding of Speech with Pyramid Vector Quantization" Proceedings of the Military Communications Conf.: pp. 620–623 (1985).

* cited by examiner

| | | |
|---|---|---|
| A | ORIGINAL UNVOICED SPEECH | $S_{UV}$ |
| B | QUANTIZED SPEECH | $S_{UV-Q}$ |
| C | ORIGINAL UNVOICED RESIDUE | $R_{UV[n]}$ |
| D | ENERGY ENVELOPE | ENV[n] |
| E | QUANTIZED RESIDUE | $R_{UV-Q}$ [n] |

PVQ ENCODING

TOTAL BITS USED $N_o$- $I_1 + I_2 + I_{31} + I_{32}$.

<u>DECODED ENERGY VALUES:</u>

$W_1 = QE_1 = \quad QMEAN_1 * QMEAN_{2,1} * QE_{21}$ $W_2 = QE_2 = \quad QMEAN_1 * QMEAN_{2,1} * QE_{22}$ $W_3 = QE_3 = \quad QMEAN_1 * QMEAN_{2,2} * QE_{23}$ $W_4 = QE_4 = \quad QMEAN_1 * QMEAN_{2,2} * QE_{24}$

LOW BIT-RATE CODING OF UNVOICED SEGMENTS OF SPEECH

BACKGROUND OF THE INVENTION

I. Field of the Invention

The present invention pertains generally to the field of speech processing, and more specifically to a method and apparatus for low bit-rate coding of unvoiced segments of speech.

II. Background

Transmission of voice by digital techniques has become widespread, particularly in long distance and digital radio telephone applications. This, in turn, has created interest in determining the least amount of information that can be sent over a channel while maintaining the perceived quality of the reconstructed speech. If speech is transmitted by simply sampling and digitizing, a data rate on the order of sixty-four kilobits per second (kbps) is required to achieve a speech quality of conventional analog telephone. However, through the use of speech analysis, followed by the: appropriate coding, transmission, and resynthesis at the receiver, a significant reduction in the data rate can be achieved.

Devices that employ techniques to compress speech by extracting parameters that relate to a model of human speech generation are called speech coders. A speech coder divides the incoming speech signal into blocks of time, or analysis frames. Speech coders typically comprise an encoder and a decoder, or a codec. The encoder analyzes the incoming speech frame to extract certain relevant parameters, and then quantizes the parameters into binary representation, i.e., to a set of bits or a binary data packet. The data packets are transmitted over the communication channel to a receiver and a decoder. The decoder processes the data packets, unquantizes them to produce the parameters, and then resynthesizes the speech frames using the unquantized parameters.

The function of the speech coder is to compress the digitized speech signal into a low-bit-rate signal by removing all of the natural redundancies inherent in speech. The digital compression is achieved by representing the input speech frame with a set of parameters and employing quantization to represent the parameters with a set of bits. If the input speech frame has a number of bits $N_i$ and the data packet produced by the speech coder has a numbe[00f8] of bits $N_o$, the compression factor achieved by the speech coder is $C_r=N_i/N_o$. The challenge is to retain high voice quality of the decoded speech while achieving the target compression factor. The performance of a speech coder depends on (1) how well the speech model, or the combination of the analysis and synthesis process described above, performs, and (2) how well the parameter quantization process is performed at the target bit rate of $N_o$ bits per frame. The goal of the speech model is thus to capture the essence of the speech signal, or the target voice quality, with a small set of parameters for each frame.

One effective technique to encode speech efficiently at low bit rate is multimode coding. A multimode coder applies different modes, or encoding-decoding algorithms, to different types of input speech frames. Each mode, or encoding-decoding process, is customized to represent a certain type of speech segment (i.e., voiced, unvoiced, or background noise) in the most efficient manner. An external mode decision mechanism examines the input speech frame and makes a decision regarding which mode to apply to the frame. Typically, the mode decision is done in an open-loop fashion by. extracting a number of parameters out of the input frame and evaluating them to make a decision as to which mode to apply. Thus, the mode decision is made without knowing in advance the exact condition of the output speech, i.e.,-how similar the output speech will be to the input speech in terms of voice-quality or any other performance measure. An exemplary open-loop mode decision for a speech codec is described in U.S. Pat. No. 5,414,796, which is assigned to the assignee of the present invention and fully incorporated herein by reference.

Multimode coding can be fixed-rate, using the same number of bits $N_o$ for each frame, or variable-rate, in which different bit rates are used for different modes. The goal in variable-rate coding is to use only the amount of bits needed to encode the codec parameters to a level adequate to obtain the target quality. As a result, the same target voice quality as that of a fixed-rate, higher-rate coder can be obtained at a significant lower average-rate using variable-bit-rate (VBR) techniques. An exemplary variable rate speech coder is described in U.S. Pat. No. 5,414,796, assigned to the assignee of the present invention and previously fully incorporated herein by reference.

There is presently a surge of research interest and strong commercial needs to develop a high-quality speech coder operating at medium to low bit rates (i.e., in the range of 2.4 to 4 kbps and below). The application areas include wireless telephony, satellite communications, Internet telephony, various multimedia and voice-streaming applications, voice mail, and other voice storage systems. The driving forces are the need for high capacity and the demand for robust performance under packet loss situations. Various recent speech coding standardization efforts are another direct driving force propelling research and development of low-rate speech coding algorithms. A low-rate speech coder creates more channels, or users, per allowable application bandwidth, and a low-rate speech coder coupled with an additional layer of suitable channel coding can fit the overall. bit-budget of coder specifications and deliver a robust performance under channel error conditions.

Multimode VBR speech coding is therefore an effective mechanism to encode speech at low bit rate. Conventional multimode schemes require the design of efficient encoding schemes, or modes, for various segments of speech (e.g., unvoiced, voiced, transition) as well as a mode for background noise, or silence. The overall performance of the speech coder depends on how well each mode performs, and the average rate of the coder depends on the bit rates of the different modes for unvoiced, voiced, and other segments of speech. In order to achieve the target quality at a low average rate, it is necessary to design efficient, high-performance modes, some of which must work at low bit rates. Typically, voiced and unvoiced speech segments are captured at high bit rates, and background noise and silence segments are represented with modes working at a significantly lower rate. Thus, there is a need for a low-bit-rate coding technique that accurately captures unvoiced segments of speech while using a minimal number of bits per frame.

SUMMARY OF THE INVENTION

The present invention is directed to a low-bit-rate coding technique that accurately captures unvoiced segments of speech while using a minimal number of bits per frame. Accordingly, in one aspect of the invention, a method of coding unvoiced segments of speech advantageously includes the steps of extracting high-time-resolution energy coefficients from a frame of speech; quantizing the high-time-resolution energy coefficients; generating a high-time-resolution energy envelope from the quantized energy coefficients; and reconstituting a residue signal by shaping a randomly generated noise vector with quantized values of the energy envelope.

In another aspect of the invention, a speech coder for coding unvoiced segments of speech advantageously includes means for extracting high-time-resolution energy coefficients from a frame of speech; means for quantizing the high-time-resolution energy coefficients; means for generating a high-time-resolution energy envelope from the quantized energy coefficients; and means for reconstituting a residue signal by shaping a randomly generated noise vector with quantized values of the energy envelope.

In another aspect of the invention, a speech coder for coding unvoiced segments of speech advantageously includes a module configured to extract high-time-resolution energy coefficients from a frame of speech; a module configured to quantize the high-time-resolution energy coefficients; a module configured to generate a high-time-resolution energy envelope from the quantized energy coefficients; and a module configured to reconstitute a residue signal by shaping a randomly generated noise vector with quantized values of the energy envelope.

DETAILED DESCRIPTION OF THE PREFERRED EMBODIMENTS

Figure 1:
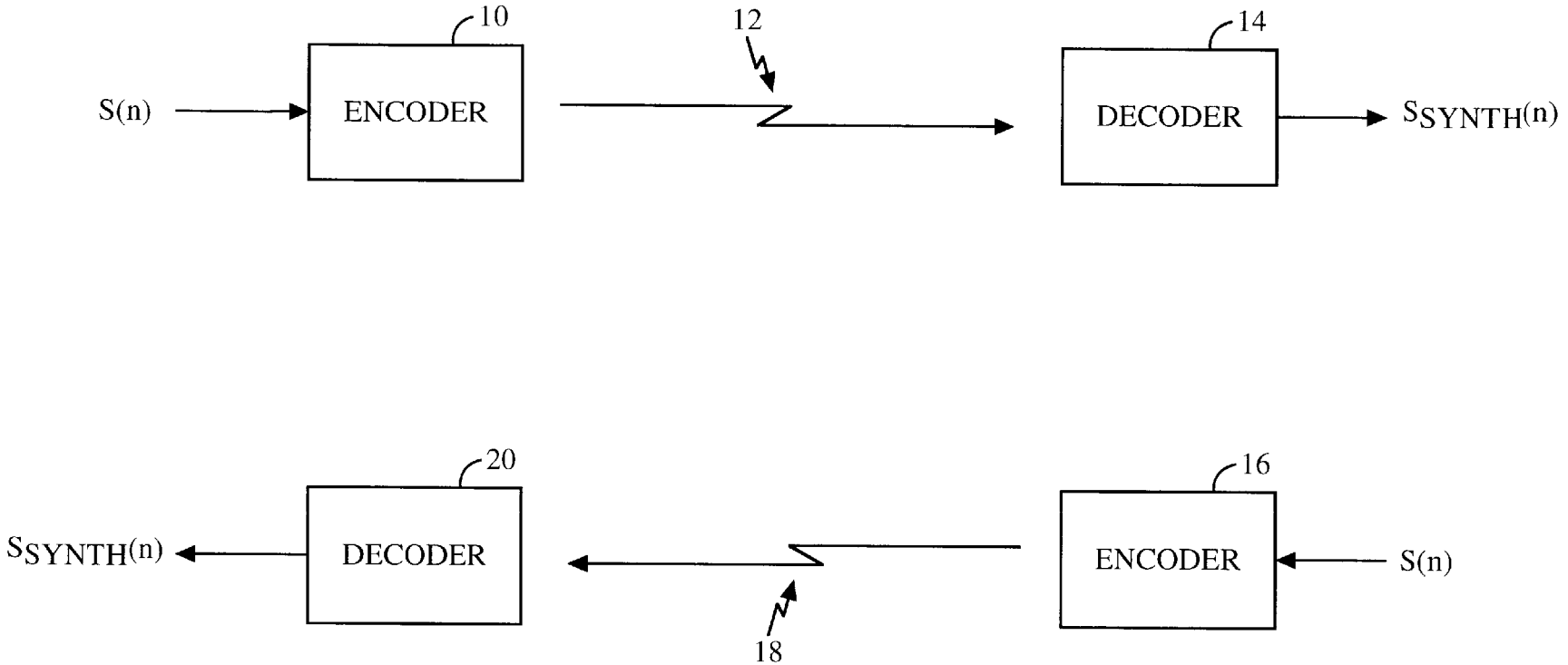
FIG. 1 is a block diagram of a communication channel terminated at each end by speech coders.

In FIG. 1 a first encoder 10 receives digitized speech samples s(n) and encodes the samples s(n) for transmission on a transmission medium 12, or communication channel 12, to a first decoder 14. The decoder 14 decodes the encoded speech samples and synthesizes an output speech signal: $S_{SYNTH}(n)$. For transmission in the opposite direction, a second encoder 16 encodes digitized speech samples s(n), which are transmitted on a communication channel 18. A second decoder 20 receives and decodes the encoded speech samples, generating a synthesized output speech signal $S_{SYNTH}(n)$.

The speech samples s(n) represent speech signals that have been digitized and quantized in accordance with any of various methods known in the art including, e.g., pulse code modulation (PCM), companded [-law, or A-law. As known in the art, the speech samples s(n) are organized into frames of input data wherein each frame comprises a predetermined number of digitized speech samples s(n). i an exemplary embodiment, a sampling rate of 8 kHz is employed, with each 20 ms frame comprising 160 samples, In the embodiments described below, the rate of data transmission may advantageously be varied on a frame-to-frame basis from 8 kbps (full rate) to 4 kbps (half rate) to 2 kbps (quarter rate) to 1 kbps (eighth rate). Varying the data transmission rate is advantageous because lower bit rates may be selectively employed for frames containing relatively less speech information. As understood by those skilled in the art, other sampling rates, frame sizes, and data transmission rates may be used.

The first encoder 10 and the second decoder 20 together comprise a first speech coder, or speech codec. Similarly, the second encoder 16 and the first decoder 14 together comprise a second speech coder. It is understood by those of skill in the art that speech coders may be implemented with a digital signal processor (DSP), an application-specific integrated circuit (ASIC), discrete gate logic, firmware, or any conventional programmable software module and a microprocessor. The software module could reside in RAM memory, flash memory, registers, or any other form of writable storage medium known in the art. Alternatively, any conventional processor, controller, or state machine could be substituted for the microprocessor. Exemplary ASICs designed specifically for speech coding are described in U.S. Pat. No. 5,727,123, assigned to the assignee of the present invention and fully incorporated herein by reference, and U.S. Pat. No. 5,784,532 entitled "VOCODER ASIC," issued Jul. 21, 1998, assigned to the assignee of the present invention, and fully incorporated herein by reference.

Figure 2:
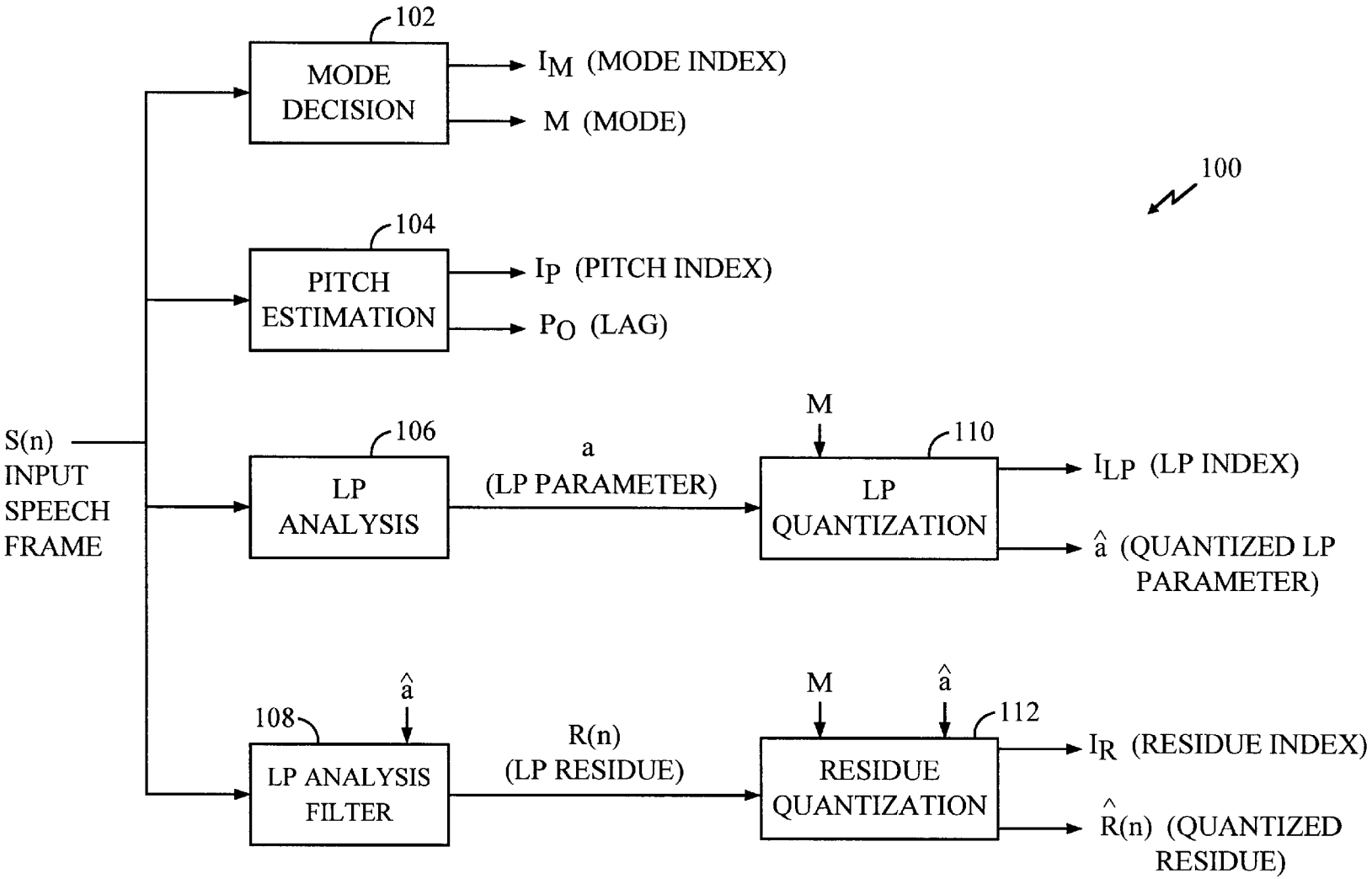
FIG. 2 is a block diagram of an encoder.

In FIG. 2, an encoder 100 that may be used in a speech coder includes a mode decision module 102, a pitch estimation module 104, an LP analysis module 106, an LP analysis filter 108, an LP quantization module 110, and a residue quantization module 112. Input speech frames s(n) are provided to the mode decision module 102, the pitch estimation module 104, the LP analysis module 106, and the LP analysis filter 108. The mode decision module 102 produces a mode index $I_M$ and a mode M based upon the periodicity of each input speech frame s(n). Various methods of classifying speech frames according to periodicity are described in U.S. Pat. No. 5,911,128 entitled "METHOD AND APPARATUS FOR PERFORMING REDUCED RATE VARIABLE RATE VOCODING," issued Jun. 8, 1999, assigned to the assignee of the present invention, and fully incorporated herein by reference. Such methods are also incorporated into the Telecommunication Industry Association Industry Interim Standards TIA/EIA IS-127 and TIA/EIA IS-733.

The pitch estimation module 104 produces a pitch index $I_P$, and a lag value $P_0$ based upon each input speech frame s(n). The LP analysis module 106 performs linear predictive analysis on each input speech frame s(n) to generate an LP parameter $\alpha$. The LP parameter $\alpha$ is provided to the LP: quantization module 110. The LP quantization module 110 also receives the mode M. The LP quantization module 110 produces an LP index $I_{LP}$ and a quantized LP parameter $\hat{\alpha}$. The LP analysis filter 108 receives the quantized LP parameter $\hat{\alpha}$ in addition to the input speech frame s(n). The LP analysis filter 108 generates an LP residue signal R[n], which represents the error between the input speech frames s(n) and the quantized linear predicted parameters $\hat{\alpha}$. The LP residue R[n], the mode M, and the quantized LP parameter $\hat{\alpha}$ are provided to the residue quantization module 112. Based upon these values, the residue quantization module 1122 produces a residue index $I_R$ and a quantized residue signal $\hat{R}[n]$.

Figure 3:
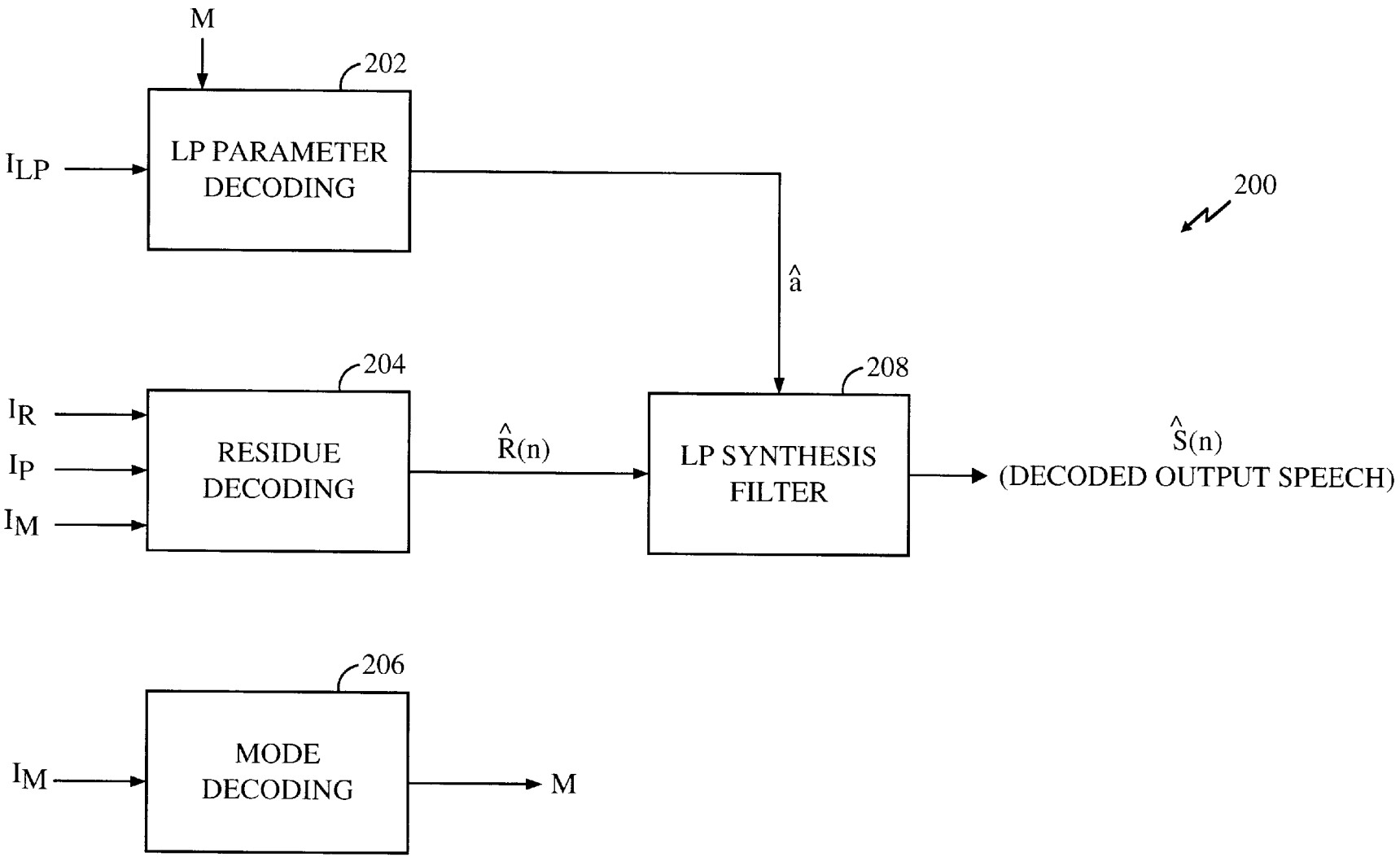
FIG. 3 is a block diagram of a decoder.

In FIG. 3 a decoder 200 that may be used in a speech coder includes an LP parameter decoding module 202, a residue decoding module 204, a mode decoding module 206, and an LP synthesis filter 208. The mode decoding module 206 receives and decodes a mode index $I_M$, generating therefrom a mode M. The LP parameter decoding module 202 receives the mode M and an LP index $I_{LP}$. The LP parameter decoding module 202 decodes the received values to produce a quantized LP parameter $\hat{\alpha}$. The residue decoding module 204 receives a residue index $I_R$, a pitch index $I_P$, and the mode index $I_M$. The residue decoding module 204 decodes the received values to generate a quantized residue signal $\hat{R}[n]$. The quantized residue signal $\hat{R}[n]$ and the quantized LP parameter $\hat{\alpha}$ are provided to the LP synthesis filter 208, which synthesizes a decoded output speech signal $\hat{S}[n]$ therefrom.

Operation and implementation of the various modules of the encoder 100 of FIG. 2 and the decoder of FIG. 3 are known in the art, and are described in detail in L. B. Rabiner & R. W. Schafer *Digital Processing of Speech Signals* 396–453 (1978), which is fully incorporated herein by reference. An exemplary encoder and an exemplary decoder are described in U.S. Pat. No. 5,414,796, previously fully incorporated herein by reference.

Figure 4:
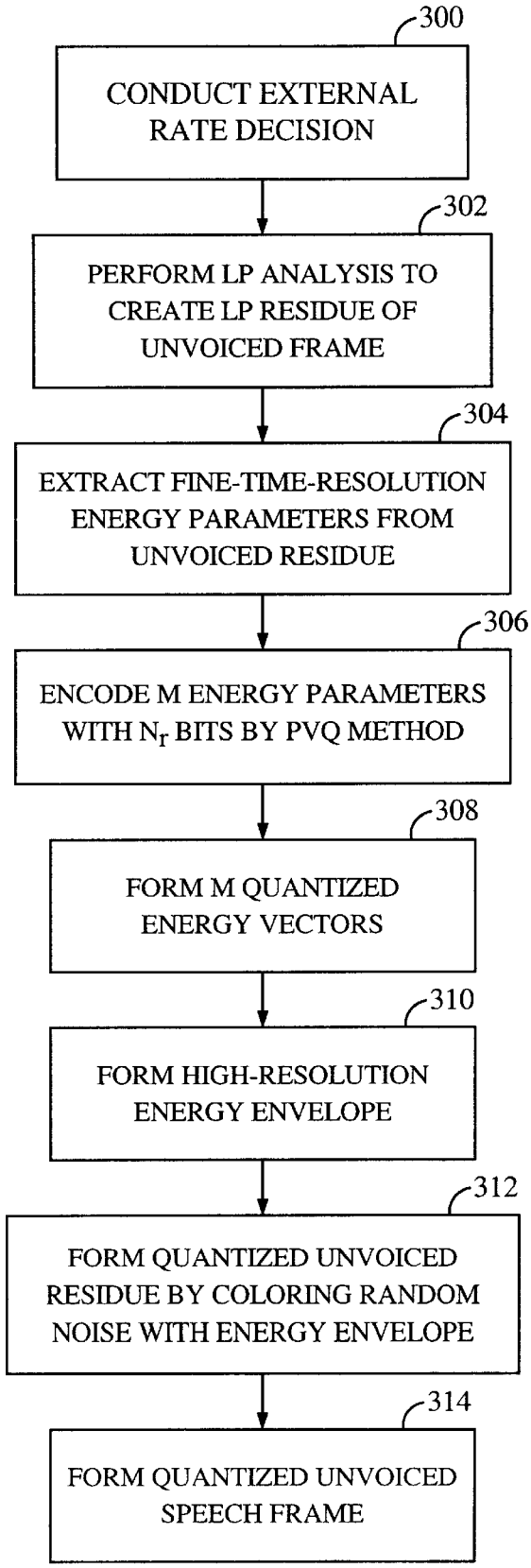
FIG. 4 is a flow chart illustrating the steps of a low-bit-rate coding technique for unvoiced segments of speech.

The flow chart of FIG. 4 illustrates a low-bit-rate coding technique for unvoiced segments of speech in accordance with one embodiment. The low-rate unvoiced coding mode shown in the embodiment of FIG. 4 advantageously offers multimode speech coders a lower average bit rate while preserving an overall high voice quality by capturing unvoiced segments accurately with a low number of bits per frame.

In step 300 the coder performs an external rate decision, identifying incoming speech frames as either unvoiced or not unvoiced. The rate decision is done by considering a number of parameters extracted from the speech frame S[n], where n=1,2,3, . . . , N, such as the energy of the frame (E), the frame periodicity (Rp), and the spectral tilt (Ts). The parameters are compared with a set of predefined thresholds. A decision is made as to whether the current frame is unvoiced based upon the results of the comparisons. If the current frame is unvoiced, it is encoded as an unvoiced frame, as described below.

The frame energy may advantageously be determined in accordance with the following equation:

$$E = \frac{1}{N} * \sum_{m=1}^{N} S[m] * S[m]$$

The frame periodicity may advantageously be determined in accordance with the following equation:

$$Rp = \text{max-over-all-k } \{R(S[n]S[n+k])\}, \text{ for } k=1,2, \ldots, N,$$

where R(x[n], x[n+k]) is an autocorrelation function of x. The spectral tilt may advantageously be determined in accordance with the following equation:

$$Ts = (Eh/El),$$

where Eh and El are the energy values of Sl[n] and Sh[n], Sl and Sh being the low-pass and high-pass components of the original speech frame S[n], which components may advantageously be generated by a set of low-pass and high-pass filters.

Figure 5:
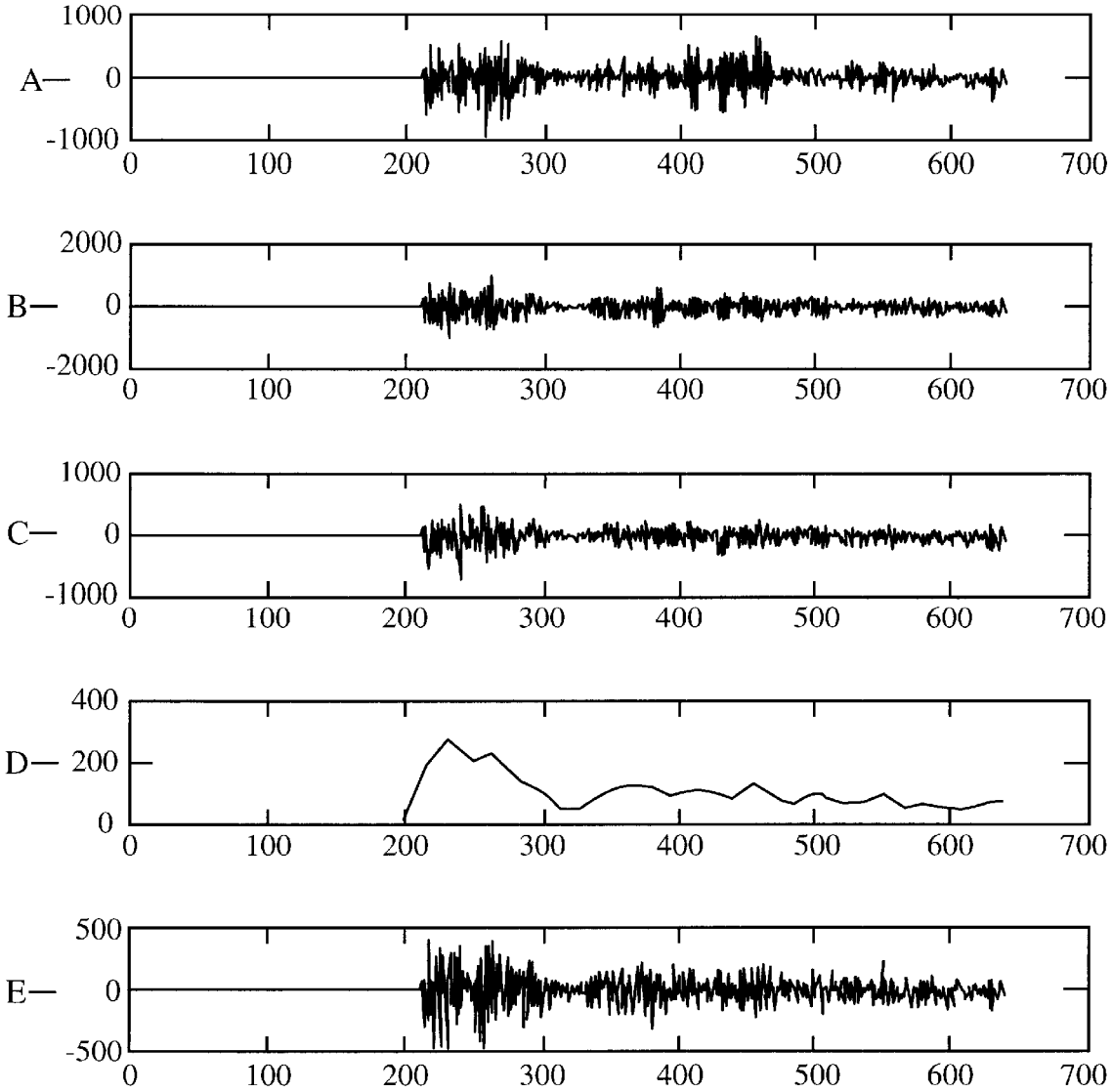
FIGS. 5A–E are graphs of signal amplitude versus discrete time index.

In step 302 LP analyses is conducted to create the linear predictive residue of the unvoiced frame. The linear predictive (LP) analysis is accomplished with techniques that are, known in the art, as described in the aforementioned U.S. Pat. No. 5,414,796 and L. B. Rabiner & R. W. Schafer *Digital Processing of Speech Signals* 396–458 (1978), both previously fully incorporated herein by reference. The N-sample, unvoiced LP residue, $\hat{R}[n]$, where n=1,2, . . . , N, is created from the input speech frame S[n], where n=1,2 . . . N. The LP parameters are quantized in the line spectral pair (LSP) domain with known LSP quantization techniques, as described in either of the above-listed references. A graph of original speech signal amplitude versus discrete time index is illustrated in FIG. 5A. A graph of quantized unvoiced speech signal amplitude versus discrete time index is illustrated in FIG. 5B. A graph of original unvoiced residue signal amplitude versus discrete time index is illustrated in FIG. 5C. A graph of energy envelope amplitude versus discrete time index is illustrated in FIG. 5D. A graph of quantized unvoiced residue signal amplitude versus discrete time index is illustrated in FIG. 5E.

In step 304 fine-time resolution energy parameters of the unvoiced residue are extracted. A number (M) of local energy parameters $E_i$, where i=1,2, . . . , M, is extracted from the unvoiced residue [n] by performing the following steps. The N-sample residue [n] is divided into (M−2) sub-blocks $X_i$, where i=2,3, . . . , M−1, with each block $X_i$ having a length of L=N/(M−2). The L-sample past residue block $X_1$ is obtained from the past quantized residue of the previous frame. (The L-sample past residue block $X_1$ incorporates the last L samples of the N-sample residue of the last speech frame.) The L-sample future residue block $X_M$ is obtained from the LP residue of the following frame. (The L-sample future residue block $X_M$ incorporates the first L samples of the N-sample LP residue of the next speech frame.) A number M of: local energy parameters $E_i$ where i=1, 2, . . . ,M, is created from each of the M blocks $X_i$, where i=1,2, . . . , M, in accordance with the following equation:

$$E_i = \frac{1}{L} * \sum_{m=1}^{L} X_i[m] * X_i[m]$$

In step 306 the M energy parameters are encoded with Nr bits according to a pyramid vector quantization (PVQ) method. Thus, the M−1 local energy values $E_i$, where i=2, 3, . . . ,M, are encoded with $N_r$ bits to form quantized energy values $W_i$, where i=2,3, . . . , M. A K-step PVQ encoding scheme with bits $N_1, N_2, \ldots, N_K$ is employed such that $N_1+N_2+\ldots+N_K=N_r$, the total number of bits available for quantizing the unvoiced residue R[n]. For each of k-stages, where k=1,2, . . . ,K, the following steps are performed. For the first stage (i.e., k=1), the band number is set to $B_k=B_1=1$, and the band length is set to $L_k=1$. For each band $B_k$, the mean value $mean_j$, where j=1,2, . . . ,$B_k$, in accordance with the following equation:

$$mean_j = \frac{1}{L_j} * \sum_{m=1}^{L_j} E_m$$

The $B_k$ mean values $mean_j$, where j=1,2, . . . , $B_k$, are quantized with $N_k=N_1$ bits to form the quantized set of mean values $qmean_i$, where j=1,2, . . . ,$B_k$. The energy belonging to each band $B_k$ is divided by the associated quantized mean value $qmean_j$, generating a new set of energy values $\{E_{k,i}\}=\{E_{1,i}\}$, where i=1,2, . . . , M. In the first-stage case (i.e., for k=1) for each i, where i=1,2,3, . . . , M,:

$$E_{1,i}=E_i/\text{qmean}_1$$

The process of breaking into sub-bands, extracting the means for each band, quantizing the means with bits available for the stage, and then dividing the components of the sub-band by the quantized mean of the subband is repeated for each subsequent stage k, where k=2,3, . . . , K−1.

Figure 6:
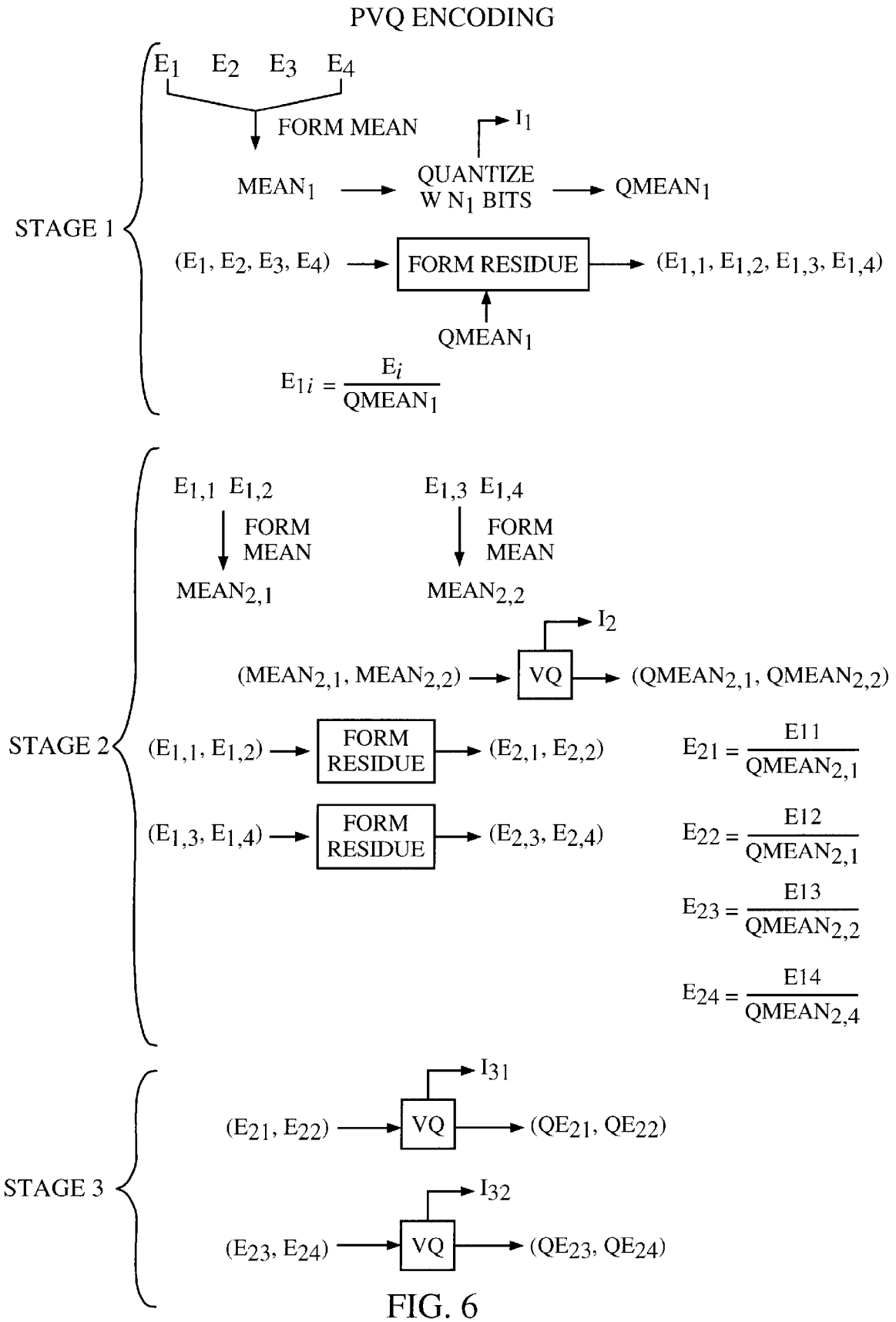
FIG. 6 is a functional diagram depicting a pyramid vector quantization encoding process.

In the K-th stage, the sub-vectors of each of the $B_K$ sub-bands are quantized with individual VQs designed for each band, using a total of $N_K$ bits. The PVQ encoding process for M=8 and stage=4 is illustrated by way of example in FIG. 6.

Figure 7:
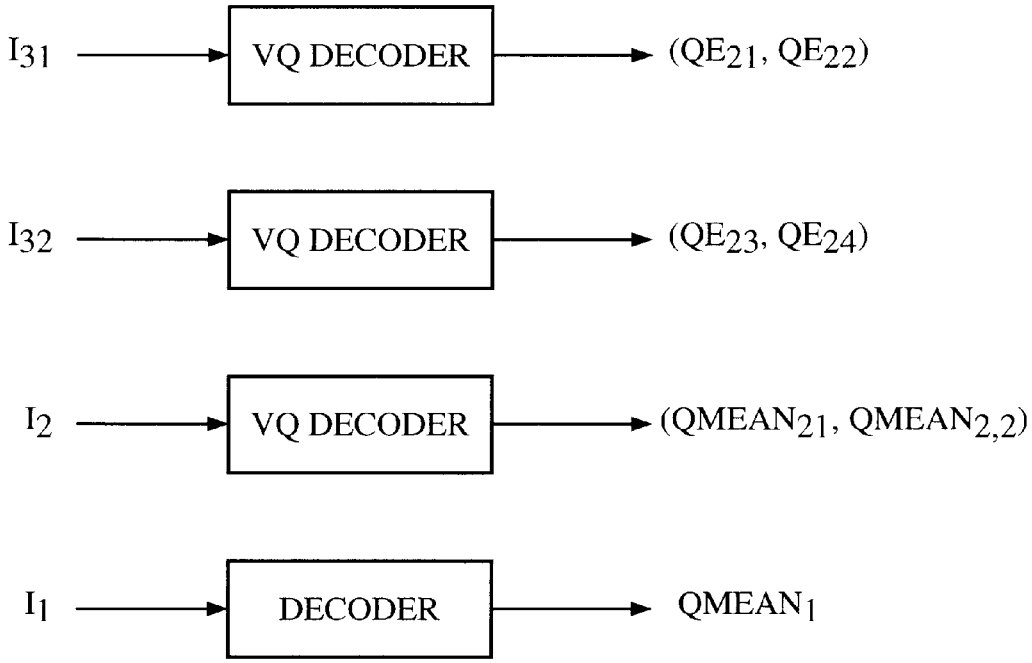
FIG. 7 is a functional diagram depicting a pyramid vector quantization decoding process.

In step 308 M quantized energy vectors are formed. The M quantized energy vectors are formed from the codebooks and the Nr bits representing the PVQ information by reversing the above-described PVQ encoding process with the final residue sub-vectors and quantized means. The PVQ decoding process for M=3 and stage k=3 is illustrated by way of example in FIG. 7. As those skilled in the art would understand, the unvoiced (UV) gains may be quantized with any conventional encoding technique. The encoding scheme need not be restricted to the PVQ scheme of the embodiment described in connection with FIGS. 4–7.

In step 310 a high-resolution energy envelope is formed. An N-sample (i.e., the length of the speech frame), high-time-resolution energy envelope ENV[n], where n=1,2, 3, . . . , N, is formed from the decoded energy values $W_i$, where i=1,2,3, . . . , M, in accordance with the computations described below. The M energy values represent the energies of M−2 sub-frames of the current residue of speech, each sub-frame having a length L=N/M. The values $W_1$ and $W_M$ represent the energy of the past L samples of the last frame of residue and the energy of the future L samples of the next frame of residue, respectively.

If $W_{m-1}$, $W_m$, and $W_{m+1}$, are representative of the energies of the (m−1)th, m-th, and (m+1)-th sub-band, respectively, then the samples of the energy envelope ENV[n], for n=m*L−L/2 to n=m*L+L/2, representing the m-th sub-frame are computed as follows: For n=m*L−L/2, until n=m*L, $$\mathrm{ENV}[n]=\sqrt{W_{m-1}}+(1/L)*(n-m*L+L)*(\sqrt{W_m}-\sqrt{W_{m-1}}).$$

And for n=m*L, until n=m*L+L/2.

$$\mathrm{ENV}[n]=\sqrt{W_m}+(1/L)*(n-m*L)*(\sqrt{W_{m+1}}-\sqrt{W_m}).$$

The steps for computing the energy envelope ENV[n] are repeated for each of the M−1 bands, letting m=2,3,4, . . . , M, to compute the entire energy envelope ENV[n], where n=1,2, . . . , N, for the current residue frame.

In step 312 a quantized unvoiced residue is formed by coloring random noise with the energy envelope ENV[n]. The quantized unvoiced residue q R[n] is formed in accordance with the following equation:

$$qR[n]=\mathrm{Noise}[n]*ENV[n],\ \text{for } n=1,2,\ldots,N,$$

where Noise[n] is a random white noise signal with unit variance, which is advantageously artificially generated by a random number generator in sync with the encoder and the decoder.

In step 314 a quantized unvoiced speech frame is formed. The quantized unvoiced residue qS[n] is generated by inverse-LP filtering of the quantized unvoiced speech with conventional LP synthesis techniques, as known in the art and described in the aforementioned U.S. Pat. No. 5,414,796 and L. B. Rabiner & R. W. Schafer *Digital Processing of Speech Signals* 396–458 (1978), both previously fully incorporated herein by reference.

In one embodiment a quality-control step can be performed by measuring a perceptual error measure such as, e.g., perceptual signal-to-noise ratio (PSNR), which is defined as:

$$PSNR = 10*\log10\frac{\sum_{n=1}^{N}(x[n]-e[n])^2}{\sum_{n=1}^{N}e[n]*e[n]}$$

where x[n]=h[n]*R[n], and e(n)=h[n]*qR[n], with "i" denoting a convolution or filtering operation, h(n) being a perceptually weighted LP filter, and R[n] and qR[n] being, respectively, the original and quantized unvoiced residue. The PSNR is compared with a predetermined threshold. If the PSNR is less than the threshold, the unvoiced encoding scheme did not perform adequately and a higher-rate encoding mode may be applied instead to more accurately capture the current frame. On the other hand, if the PSNR exceeds the predefined threshold, the unvoiced encoding scheme has performed well and the mode-decision is retained.

Preferred embodiments of the present invention have thus been shown and described. It would be apparent to one of ordinary skill; in the art, however, that numerous alterations may be made to the embodiments herein disclosed without departing from the spirit or scope of the: invention. Therefore, the present invention is not to be limited except in accordance with the following claims.

What is claimed is:

1. A method of coding unvoiced segments of speech, comprising the steps of:

extracting high-time-resolution energy coefficients from a time-domain representation of a frame of speech, wherein a predefined number of sub-frames comprises voiced and unvoiced segments of speech;

quantizing the high-time-resolution energy coefficients;

generating a high-time-resolution smoothed energy envelope from the quantized energy coefficients; and reconstituting a residue signal by shaping a randomly generated noise vector with the reconstructed smoothed energy envelope.

2. The method of claim 1, wherein the quantizing step is performed in accordance with a pyramid vector quantization scheme.

3. The method of claim 1, wherein the generating step is accomplished with linear interpolation.

4. The method of claim 1, further comprising the steps of obtaining a post-processing performance measure and comparing the post-processing performance measure with a predetermined threshold.

5. The method of claim 1, wherein the generating step comprises generating a high-time-resolution energy envelope including a representation of energy of a predefined number of past samples of a previous frame of residue.

6. The method of claim 1, wherein the generating step comprises generating a high-time-resolution energy envelope including a representation of energy of a predefined number of future samples of a next frame of residue.

7. A speech coder for coding unvoiced segments of speech, comprising:

means for extracting high-time-resolution energy coefficients from a time-domain representation of a frame of speech, wherein a predefined number of sub-frames comprises voiced and unvoiced segments of speech;

means for quantizing the high-time-resolution energy coefficients;

means for reconstructing a high-time-resolution smoothed energy envelope from the quantized energy coefficients; and means for reconstituting a residue signal by shaping a randomly generated noise vector with the reconstructed smoothed energy envelope.

8. The speech coder of claim 7, wherein the means for quantizing comprises means for quantizing in accordance with a pyramid vector quantization scheme.

9. The speech coder of claim 7, wherein the means for generating comprises a linear interpolation module.

10. The speech coder of claim 7, further comprising means for obtaining a post-processing performance measure and means for comparing the post-processing performance measure with a predetermined threshold.

11. The speech coder of claim 7, wherein the means for generating comprises means for generating a high-time-resolution energy envelope including a representation of energy of a predefined number of past samples of a previous frame of residue.

12. The speech coder of claim 7, wherein the means for generating comprises means for generating a high-time-resolution energy envelope including a representation of energy of a predefined number of future samples of a next frame of residue.

13. A speech coder for coding unvoiced segments of speech, comprising:

a module configured to extract high-time-resolution energy coefficients from a time-domain representation of a frame of speech;

a module configured to quantize the high-time-resolution energy coefficients;

a module configured to generate a high-time-resolution energy envelope from the quantized energy coefficients; and a module configured to reconstitute a residue signal by shaping a randomly generated noise vector with quantized values of the energy envelope.

14. The speech coder of claim 13, wherein the quantizing is conducted in accordance with a pyramid vector quantization scheme.

15. The speech coder of claim 13, wherein the generation is performed with linear interpolation.

16. The speech coder of claim 13, further comprising a module configured to obtain and compare a post-processing performance measure with a predetermined threshold.

17. The speech coder of claim 13, wherein the high-time-resolution energy envelope includes a representation of energy of a predefined number of past samples of a previous frame of residue.

18. The speech coder of claim 13, wherein the high-time-resolution energy envelope includes a representation of energy of a predefined number of future samples of a next frame of residue.

19. A method of coding unvoiced segments of speech, comprising:

computing energy values from at least a predefined number of sub-frames of a frame of speech, wherein said predefined number of sub-frames comprises voiced and unvoiced segments of speech;

quantizing the energy values;

generating a fine-time-resolution energy envelope from the quantized energy values; and scaling a random noise vector with the energy envelope to reconstitute a residue signal.

20. A speech coder for coding unvoiced segments of speech, comprising:

means for computing energy values from at least a predefined number of sub-frames of a frame of speech, wherein said predefined number of sub-frames comprises voiced and unvoiced segments of speech;

means for quantizing the energy values;

means for generating a fine-time-resolution energy envelope from the quantized energy values; and means for scaling a random noise vector with the energy envelope to reconstitute a residue signal.

21. A speech coder for coding unvoiced segments of speech, comprising:

a processor; and a storage medium coupled to the processor and containing a set of instructions executable by the processor to compute energy values from at least a predefined number of sub-frames of a frame of speech, quantize the energy values, generate a fine-time-resolution energy envelope from the quantized energy values, and scale a random noise vector with the energy envelope to reconstitute a residue signal.

* * * * *